US005655191A

United States Patent [19]

Furuya et al.

[11] Patent Number: 5,655,191

[45] Date of Patent: Aug. 5, 1997

[54] COLOR IMAGE RECORDING METHOD FOR TRANSFERRING A MULTI-COLORED IMAGE TO AN IMAGE RECEPTOR

[75] Inventors: Nobumasa Furuya; Takeshi Sumikawa; Shigehito Ando; Shinji Sasahara; Tadakazu Edure, all of Nakai-machi, Japan

[73] Assignee: Fuji Xerox Co., Ltd., Tokyo, Japan

[21] Appl. No.: 549,210

[22] Filed: Oct. 27, 1995

[30] Foreign Application Priority Data

Apr. 11, 1995 [JP] Japan ..... 7-110034

[51] Int. Cl.[6] ..... G03G 15/01

[52] U.S. Cl. ..... 399/231; 399/270; 399/277; 430/45

[58] Field of Search ..... 355/245, 251, 355/264, 326 R, 327, 246; 118/645, 657, 658; 430/45, 122; 399/231, 270, 277

[56] References Cited

U.S. PATENT DOCUMENTS 4,089,297 5/1978 Morita et al. ..... 118/658 X
4,797,335 1/1989 Hiratsuka et al. ..... 118/657 X
5,030,996 7/1991 Tajima et al. ..... 355/246

FOREIGN PATENT DOCUMENTS

A-2-77767 3/1990 Japan .
B2-3-2304 1/1991 Japan .
A-3-206473 9/1991 Japan .

*Primary Examiner*—Joan H. Pendegrass
*Attorney, Agent, or Firm*—Oliff & Berridge

[57] ABSTRACT

In a color image forming apparatus, as the second and subsequent development processes of the simultaneously transfer type, a non-contact type AC field double-element development is employed, and an absolute value of the difference between the maximum bias which provides the maximum toner developing electric field in the direction to the side of the latent image carrier and the average value of the developing bias is set larger than an absolute value of the difference between the minimum bias voltage which provides the minimum toner developing electric field in the direction to the side of the latent image carrier and the average value of the developing bias, while the bias voltage region located between the maximum bias voltage and the average bias voltage is set to a ratio of from 0.25 to 0.45 for one period of the AC voltage, and the frequency of the bias voltage is set from 4 kHz to 10 kHz.

10 Claims, 5 Drawing Sheets

COLOR IMAGE RECORDING METHOD FOR TRANSFERRING A MULTI-COLORED IMAGE TO AN IMAGE RECEPTOR

BACKGROUND OF THE INVENTION

1. Field of the Invention

The present invention relates to a color image recording method utilizing an electrophotographic recording method and particularly to an improvement in the color image recording method in such a type as recording color images by forming a color image of a plurality of colors on a latent image carrier such as a photosensitive material, etc. and transferring such color image of a plurality of colors simultaneously to an image acceptor such as a recording sheet.

2. Description of the Prior Art

Various kinds of methods have been proposed as color image recording methods utilizing an electrophotographic recording method and so-called superimposed development methods. In this superimposed development method, a plurality of color images are formed on a latent image carrier by sequentially superimposing and developing images in a plurality of colors on the relevant latent image carrier, such as a photosensitive material drum, etc., and a color image can be obtained by transferring at a time such a plurality of color images on the recording sheet.

This method has an advantage that an image can be formed at a higher rate because the apparatus can realize size reduction since it requires only one latent image carrier such as a photosensitive material drum and does not require a drum for holding a recording sheet and a transfer drum and because a plurality of color images can be formed while the latent image carrier makes a turn by providing a plurality set of a latent image forming device and a developer unit around the latent image carrier.

In such a superimposed development method, it has been an extremely important technical problem how one may skillfully execute the second and subsequent development processes without disturbing or removing a toner image on the latent image carrier because the already developed toner image passes again through the development area in the development processes for second and subsequent colors following the development process for the first color.

As a method of developing an electrostatic latent image formed on a latent image carrier, various methods employing a so-called contact type double-element magnetic brush development method have been proposed. In these methods, for example, an electrostatic latent image is visualized by placing the surface of the latent image carrier in contact with the double-element developer consisting of toner and magnetic carrier. This development method is thought of as a typical development method because it has some problems that toner density control is necessary and an apparatus becomes large in size but it is superior in image quality, sustainability and conveyability of the developer.

When the contact type double-element magnetic brush development explained above is employed in the second and subsequent development processes of the above-mentioned development method, a toner image of the first color generates brush-mark or sweeping by magnetic brush, resulting in the disadvantage that a toner image may be disturbed easily.

Moreover, a toner image of the first color is removed from the latent image carrier and is then mixed into the second developer in the second development process, resulting in another disadvantage that the image density of the first color image is lowered and life expectation of the second developer is remarkably lowered.

Therefore, in view of overcoming such disadvantages, various techniques utilizing a so-called non-contact development method have been proposed for realizing development without allowing contact between the latent image carrier and the developer in the second and subsequent development processes.

As with the non-contact development method, a development method utilizing a vibration voltage consisting of an AC voltage to which a DC voltage is superimposed and a development method utilizing only DC voltage have been well known.

The latter method is inferior in the fine line reproducibility to the contact type development method because the development field working on the toner is rather weak. Moreover, a gap between a latent image carrier and a development roll must be set narrow to obtain sufficient developing electric field intensity, requiring a higher mechanical accuracy. Meanwhile, since the former method is superior in the developing field intensity working on the toner to the latter method and thereby the technical problem explained above can be improved, it is concluded that the former method has advantages to the latter method.

However, in the former development method, a novel technical problem is generated due to application of a vibration voltage.

Namely, the vibration voltage causes an intensive electric field to work on the toner to scatter it on the latent image carrier, resulting in a disadvantage of mixing of colors, where the toner of the subsequent stages is deposited to the toner image of the preceding stages on the latent image carrier.

Meanwhile, when an amplitude of vibration voltage is set higher in order to obtain sufficient image density, an electric field which works on the toner of the first color on the latent image carrier to reversely scatter it in the side of the development roll is intensified, resulting in a disadvantage that the toner image of the first color is electrically disturbed and removed.

Moreover, when the magnetic carrier electrostatically vibrates and a developer layer is placed in contact with a toner image of the first color on the latent image carrier, there is provided a disadvantage that the toner image is disturbed and removed as in the case of the contact development method.

In addition, there is also provided a disadvantage that the magnetic carrier is easily transferred onto the latent image carrier, that is, the carrier is deposited easily. If carrier is deposited, the carrier transferred on the latent image carrier is placed in contact with a recording sheet together with a toner image in the transfer region. Thereby, image quality is deteriorated, for example, missing or removal of toner image is generated and the carrier is transferred on the recording sheet to create a black point.

For this reason, various techniques for setting the developing bias voltage have been proposed to overcome such technical problems.

For example, an image forming method disclosed in the official gazette of the Japanese Patent Publication No. HEI 3-2304 is constituted to satisfy the formulae, $$0.2 \leqq VAC/(d \cdot f)$$

$$\{(VAC/d)-1500\}/f \leqq 1.0$$

when an amplitude of the AC element of the developing bias is defined as VAC(V), frequency as f (Hz) and a gap between the latent image carrier and a developer carrier for transferring the developer as d (mm) in the development process of the second and subsequent colors.

Moreover, a multicolor electrostatic recording apparatus disclosed in the official gazette of the Japanese Patent Laid-Open No. HEI 2-77767 is not always based on the fact that it is employed for a double-element development system or non-contact type development system, but, in this multicolor electrostatic recording apparatus, the developing bias to be impressed to the development roll is set so that the waveform of such bias provides difference between a half value (½) and an average voltage value of the maximum voltage in one period of such waveform of bias voltage in the development process of the second color.

In addition, the above official gazette also discloses that the developing bias waveform is set as explained above, the maximum electric field working in such a direction as attracting a toner image of the preceding stage on the latent image carrier to the development roll is set to 2.3 V/m or less and the maximum electric field working in such a direction as scattering the developer on the development roll onto the latent image carrier is set to 2.8 V/m or more.

Furthermore, the image forming apparatus disclosed in the Japanese Patent Laid-Open No. HEI 3-206473 is constituted to adjust a duty ratio and a peak value of the developing bias voltage in the developer unit of the first color and the developer unit of the second color for each developer unit. Meanwhile, this official gazette also discloses that the developing magnetic poles are arranged anywhere desired other than the position where the development roll and latent image carrier are provided closest with each other and the double-element developer consisting of toner and magnetic carrier is held on the non-contact basis from the latent image carrier for the purpose of development.

However, the image forming method disclosed in the official gazette of the Japanese Patent Publication No. HEI 3-2304 still has such a technical problem that so-called carrier deposition resulting in deposition of carrier particles at the peripheral areas and areas between lines of line images is generated easily when an image having a higher space frequency such as a Chinese character having a large number of strokes is developed.

Carrier deposition is generated in such a manner that since an electrostatic latent image, where an image section and a background section are adjacently located keeping a very small clearance therebetween, exists at the surface of the latent image carrier in the case of a Chinese character having a large number of strokes having a higher space frequency, fringe field is generated at the boundary (edge) of the image section and the background section due to the electrostatic latent image at the surface of the latent image carrier. The carrier charged inversely from the toner is deposited to the edge portion and to the areas between lines of the image due to the fringe field having a higher electric field intensity formed at the edge portion of the image section.

Meanwhile, when the processing speed becomes higher and thereby the development roll rotates at a higher speed, a centrifugal force working on the carrier also increases bringing about a result that carrier deposition and scattering of carrier are generated more easily. This image forming method has a technical problem that it is not suitable for the high speed processing.

In addition, the image forming method of the type explained above has a technical problem that when the amount of charge of the developer is changed due to environmental change or passage of time, for example, when the amount of charge of the developer is increased under the low temperature environment or when it is increased with passage of time, electrostatic vibration of the magnetic carrier with impression of the vibration voltage increases with an increase in the amount of charge of carrier and thereby the developer layer is easily placed in contact with the surface of the latent image carrier. When the developer layer is placed in contact with the surface of latent image carrier, disturbance and removal of the toner image in the preceding stage and carrier deposition are generated as explained previously.

On the other hand, the multicolor electrostatic recording apparatus disclosed in the official gazette of the Japanese Patent Laid-Open No. HEI 2-77767 is difficult, when the non-contact development system utilizing the double-element developer is applied, to establish compatibility of sufficient reproduction of image density and prevention of image fault such as mixing of colors, mixed migration and carrier deposition, only with the setting of the developing bias waveform where a half value (½) of the maximum voltage in one period of the waveform is different from average voltage value.

It is because the toner and carrier are charged in the inverse polarities and thereby these elements receive an electrostatic force to move in the opposite directions with each other under the equal electric field, resulting in the requirement that the developing bias voltage must be set considering the movements of both toner and carrier depending on the effect of the electric field.

Meanwhile, the multicolor electrostatic recording apparatus of the type explained previously has such a technical problem that when the amount of charges of the carrier increases even if the maximum electric field working for attracting the toner image of the preceding stage on the latent image carrier to the development roll is set to 2.3 V/m or less, electrostatic vibration of carrier due to the effect of the vibration voltage increases, causing the developer layer to be placed in contact with the surface of the latent image carrier, followed by disturbance of toner image in the preceding stage, mixed migration and carrier deposition.

Moreover, the image forming apparatus disclosed in the official gazette of the Japanese Patent Laid-Open No. HEI 3-206473 has a technical problem that since tone reproducibility changes depending on the duty ratio and peak value of the developing bias voltage, the tone control method is different for each developer unit and thereby the tone reproducibility control under the change in amount of charge of developer and environmental change may be complicated. Particularly, when a large number of developer units are used, for example, when a full-color image is to be formed with the developer units for four colors of black, yellow, magenta and cyan, the above-mentioned image forming apparatus has a technical problem that the tone reproducibility control is extremely complicated.

Furthermore, in the image forming apparatus of the type explained above, since the development poles are arranged at the position other than the area where the development roll and the latent image carrier are provided closest with each other, a magnetic brush is intensively constrained on the development roll with the effect of the magnetic field in the horizontal direction at the area nearest the latent image carrier. Therefore, this image forming apparatus has a technical problem that it is difficult to obtain sufficient development density because the toner is developed from the upper most layer of the magnetic brush.

Meanwhile, the above image forming apparatus has another technical problem that it is difficult to establish compatibility against mixing of color on the toner image in the preceding stage on the latent image carrier and fogging on the background section because the vibration field intensity must be increased to obtain sufficient development density.

SUMMARY OF THE INVENTION

In view of solving the technical problems explained above of the prior arts, it is therefore an object of the present invention to provide a novel color image recording method which can prevent disturbance of image in the preceding stage, fall of density, mixing of colors and migration of toner of the preceding stage into the development means of the succeeding stage and assures sufficient image quality for the second and subsequent colors.

Namely, as shown in FIG. 1, the present invention relates to a color image recording method to form a toner image of a plurality of colors on a latent image carrier 1 by repeating the latent image forming process and development process for a plurality of times and then transfer at a time the toner image of a plurality of colors to an image acceptor, wherein at least the second and subsequent development processes comprises the steps for separately arranging a developer carrier 2 providing therein the magnetic poles 3 against the latent image carrier 1, transferring the double-element developer G consisting of toner and magnetic carrier onto the developer carrier 2 while it is supported non-contact with the latent image carrier 1, and impressing the developing bias VB consisting of AC voltage allowing superimposition of a DC voltage to the developer carrier 2 to develop the electrostatic image formed on the latent image carrier 1 with the toner, thereby an absolute value A of the difference between the maximum bias voltage $V_{max}$ which provides the maximum toner development field to the side of latent image carrier 1 and an average value $V_{ave}$ of the developing bias is set, as the developing bias VB explained above, larger than an absolute value B of the difference between the minimum bias voltage $V_{min}$ which provides the minimum toner development field to the side of the latent image carrier 1 and the average value $V_{ave}$ of the developing bias, and moreover the bias voltage region C located between the maximum bias voltage $V_{max}$ and the average value $V_{ave}$ of the developing bias is set to the ratio ranging from 0.25 to 0.45 for one period T of the AC voltage element.

In such technical means, the developing bias VB is not limited only to a rectangular pulse where the maximum bias voltage $V_{max}$ and the minimum bias voltage $V_{min}$ become constant and includes, for example, a sine wave signal and a signal having the waveform where the peak value of the rectangular pulse waveform changes with time.

In order to effectively control electrostatic vibration of the carrier, it is preferable that the frequency D of the AC voltage element of the developing bias VB is set to a range from 4 kHz to 10 kHz.

Moreover, it is preferable, to enhance the development efficiency in the effective development region M, that a plurality of magnetic poles 3 in different polarities are alternately arranged, for example, within the developer carrier 2 in the effective development region M at least in the second and subsequent development processes.

According to the technical means explained above, since an absolute value A of the difference between the maximum bias voltage $V_{max}$ which provides the maximum electric field for developing the toner on the latent image carrier 1 and the average value $V_{ave}$ of the developing bias voltage is set larger than an absolute value B of the difference between the minimum bias voltage $V_{min}$ which provides the minimum electric field for developing the toner on the latent image carrier 2 and the average value $V_{ave}$ of the developing bias voltage, the more intensified development electric field may be applied to the toner in comparison with the case where voltage difference described above is equal to the average value of developing bias voltage, and therefore it is possible to apply the sufficient force to separate the toner from the carrier to scatter onto the latent image carrier 1.

Simultaneously, since the electric field for developing the carrier charged inversely for the toner on the latent image carrier 1 becomes weak, electrostatic vibration of carrier is suppressed.

Further, since the bias voltage region C located between the maximum bias voltage $V_{max}$ which provides the maximum electric field for developing the toner extending to the side of the latent image carrier 1 and the average value $V_{ave}$ of the developing bias voltage is set to a ratio in the range from 0.25 to 0.45 for one period of the AC voltage element, the sufficient time for developing the toner on the latent image carrier 1 corresponding to the image area can be obtained and the toner does not reach the area on the latent image carrier 1 corresponding to the background area.

Moreover, since the frequency D of the AC voltage element is set to the range from 4 kHz to 10 kHz, the carrier having a heavier mass than the toner cannot follow up the change of electric field and the electrostatic vibration of the carrier becomes very small.

Therefore, even when the charge of carrier increases due to the environmental change or change of carrier itself with time, electrostatic vibration of the carrier is effectively suppressed.

In addition, when the material wherein a plurality of magnetic poles 3 having different polarities are alternately arranged within the areas corresponding to the effective development region M is used as the developer carrier 2 which is used at least for the second and subsequent development processes, inversion of the developer G layer, in other words, replacement of the upper and lower layers of the developer G layer is generated for a plurality of times in the effective development region M at least in the second and subsequent development processes.

Namely, the developer of which toner has been consumed and the developer of which toner is not yet consumed are replaced with each other and thereby higher development effect can be obtained in comparison with the case where the inversion of the developer G layer is not carried out.

As a result, moreover, an AC voltage is kept lower, vibration of carrier due to the vibration electric field is as much lowered and the electric field for inversely scattering the toner of the preceding stage on the latent image carrier 1 to the side of the developer carrier 2 becomes lower.

DESCRIPTION OF THE PREFERRED EMBODIMENT

The present invention will be explained in detail based on the embodiment of the present invention with reference to the accompanying drawings.

Figure 1:
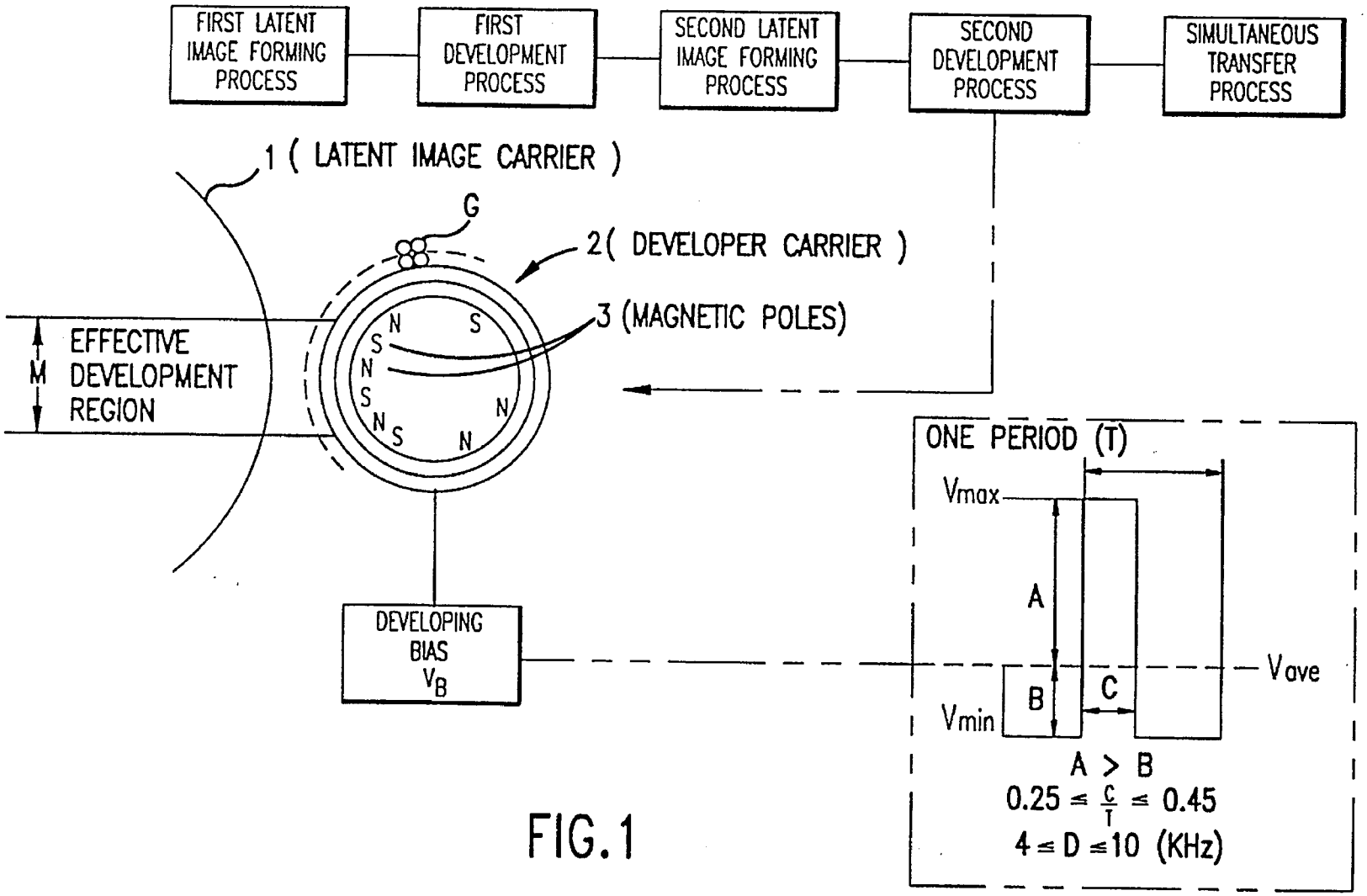
FIG. 1 is an explanatory diagram indicating a color image recording method of the present invention.
Figure 2:
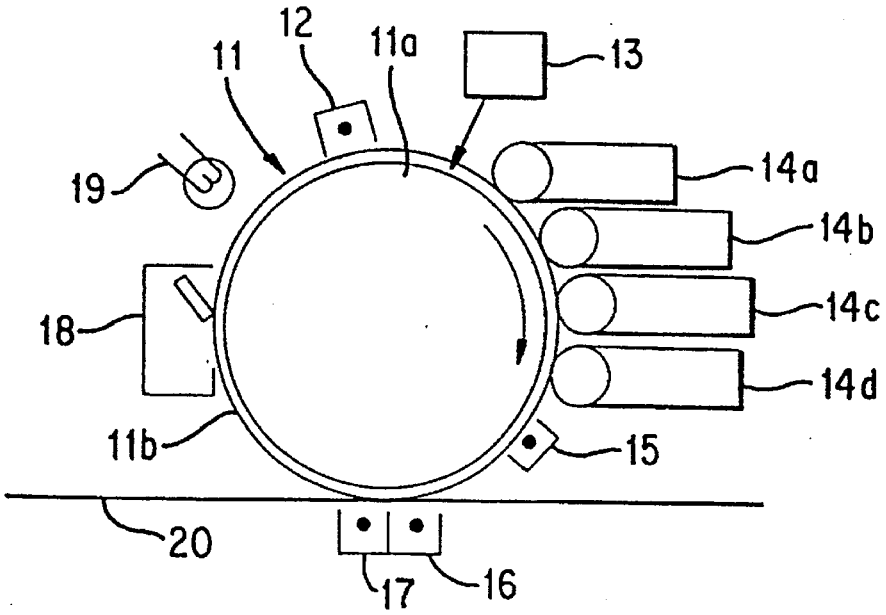
FIG. 2 is an explanatory diagram indicating an embodiment of a color image recording apparatus to which the present invention is applied.

FIG. 2 shows an embodiment of a color image recording apparatus to which a color image recording method of the present invention is applied.

In this figure, the reference numeral 11 designates a photosensitive material drum as a latent image carrier. This photosensitive material drum 11 is composed of a thin photosensitive material layer 11*b* formed on the surface of a cylindrical member 11*a* composed of a conductive material.

In this embodiment, as the photosensitive material, for example, a negatively charged organic photosensitive material (hereinafter abbreviated as OPC) is used. Moreover, an outer diameter of the photosensitive drum 11 is set, for example, to 160 mm and the surface moving line velocity, namely the process speed is set, for example, to 160 mm/s.

Around this photosensitive material drum 11, there are sequentially provided with a charging device, for example, consisting of corotron for charging a photosensitive material drum along the rotating direction thereof, an exposing device 13 consisting, for example, of a laser writing device to form an electrostatic latent image through irradiation of light beam depending on image data of each color element (exposure in the image section in this embodiment), a first developer unit 14*a* to a fourth developer unit 14*d*, for example, for yellow, magenta, cyan and black to realize inverse development of the electrostatic latent image formed on the photosensitive material drum 11 with corresponding color toners (a double-element developer consisting of non-magnetic toner and magnetic carrier is used in this embodiment), a precharging device 15, for example, consisting of Corotron for charging or discharging, after the toner images of respective color elements are formed, the toner image and photosensitive material drum 11 to the condition most suitable for transfer of toner image, a transfer charging device 16 consisting, for example, of Corotron for transferring at a time the toner images of respective colors to a recording sheet 20 which is supplied along a paper guide not illustrated, a separation charging device 17 consisting, for example, of Corotton for separating the recording sheet 20 adhered to the photosensitive material drum 11 after transfer of toner image, a cleaner 18 for removing remaining toner on the photosensitive material drum 11 and a discharge exposing device 19 for discharging remaining charges on the photosensitive material drum 11.

Figure 3:
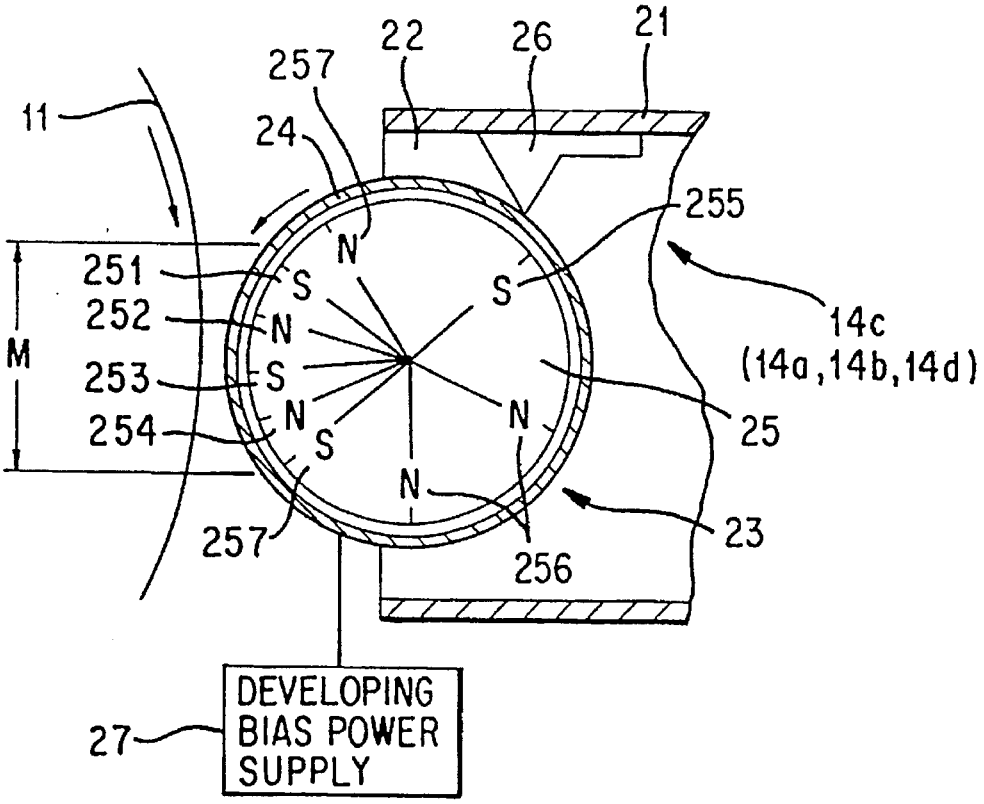
FIG. 3 is a constitutional diagram indicating the details of a developer unit used in the color image recording apparatus of the preferred embodiment of the present invention.

Next, the developer units 14*a* to 14*d* used in this embodiment will be explained in detail with reference to FIG. 3. Since the constitution of the developer units 14*a* to 14*d* is common, the third developer unit 14*c* will be explained as an example.

This third developer unit 14*c* provides an aperture 22 for development at the position opposed to the photosensitive material drum 11 of a development housing 21 in which the developer not illustrated is accommodated and also arranges a development roll 23 facing against the aperture 22 for development.

In this embodiment, the development roll 23 is composed of a non-magnetic cylindrical sleeve 24 rotating in the direction of arrow mark and a magnet roll 25 which is fixed within the cylindrical sleeve 24 and arranges a plurality of magnetic poles, for example, through magnetization.

In the upstream side of the effective development region M (region effectively working for development) of the development roll 23, a layer thickness regulating member 26 for regulating layer thickness of the developer is arranged near the development roll 23.

Moreover, the magnetic roll 25 corresponding to the effective development region M of the development roll 23 is provided with a plurality of (four, in this embodiment) developing magnetic poles 251 to 254 of different polarities and the intermediate position of the developing magnetic poles 252, 253 is arranged nearest the photosensitive material drum 11. Further, a pickup magnetic pole 255 for supplying the developer is also provided rather in the upstream side in the rotating direction of the cylindrical sleeve 24 of the position opposed to the layer thickness regulating member 26, a pair of pick-off magnetic poles 256 in the same polarity for removing the developer remaining on the development roll 23 is provided in the more upstream side of the pickup magnetic pole 255 in the rotating direction of the cylindrical sleeve 24, and a transfer magnetic pole 257 for transferring the developer is respectively provided between the developing magnetic pole 251 and pickup magnetic pole 255 and between the developing magnetic pole 254 and the pick-off magnetic pole 256.

Furthermore, the predetermined developing bias VB is impressed to the cylindrical sleeve 24 with the developing bias power supply 27. This developing bias VB is so-called a vibration voltage consisting of an AC voltage to which a DC voltage is superimposed and is selected practically on the basis of the result of experiment which will be explained later.

Here, the more practical conditions will be described. In this embodiment, an outer diameter of the cylindrical sleeve 24 is set to 18 mm, a gap between the photosensitive material drum 11 and cylindrical sleeve 24 is set to 500 m, a developer layer thickness at the area opposed to the photosensitive material drum 11, that is, almost at the intermediate area between the developing magnetic poles 252 and 253 is set to 200 m, and the developer layer is kept in the non-contact condition to the photosensitive material drum 11.

In this embodiment, moreover, an angle between magnetic poles of the developing magnetic poles 251 to 254 and transfer magnetic pole 257 is set to 19 degrees, an outer diameter of the non-magnetic cylindrical sleeve 11 is set to 18 mm and a peak value of the magnetic flux density in the radius direction at the surface of the cylindrical sleeve 24 of these six magnetic poles is set to 30 mT (300 G).

In such developer unit 14*c*, when the developer is supplied to the development roll 23, the developer is transferred depending on the magnetic field of the magnet roll 25 while it is adhered to the cylindrical sleeve 24 and is regulated to a constant thickness by the layer thickness regulating member 26 and is moreover transferred to the effective development region M opposed to the photosensitive material drum 11 with rotation of the cylindrical sleeve 24 to develop the electrostatic latent image on the photosensitive material drum 11.

Here, the effective development region M means the region where the toner on the cylindrical sleeve 24 scatters to the side of the photosensitive material drum 11 to substantially visualize the latent image on the photosensitive material drum 11 and it means more practically the region where the toner on the cylindrical sleeve 24 scatters to the side of the photosensitive material drum 11 under the condition that the electrical field which is similar to that impressed during the development is applied when the cylindrical sleeve 24 and the photosensitive material drum 11 have stopped.

Next, the image forming process of this color image recording apparatus will be explained.

In the color image recording apparatus, the photosensitive material drum 11 is rotatably driven in the direction of arrow mark by way of a driving means not illustrated. The surface of this photosensitive material drum 11 is uniformly charged to the predetermined voltage by the charging device 12. Thereafter, on the surface of the photosensitive material drum 11, an electrostatic latent image is formed through the exposure corresponding to an yellow image by an exposing device 13.

Thereafter, the electrostatic latent image of yellow is developed by an yellow toner in the first developer unit 14*a*.

Next, as the second cycle, the surface of photosensitive material drum 11 is recharged by the charging device 12 so that the surface of the photosensitive material drum 11 which has been lowered by the exposure of the exposing device 13 in the preceding yellow image forming process is charged up to the voltage which is almost equal to the initial voltage.

Thereafter, an electrostatic latent image is formed at the surface of the photosensitive material drum 11 through the exposure corresponding to a magenta image by way of the exposing device 13.

Next, the electrostatic latent image of magenta is developed by the magenta toner in the second developer unit 14*b*.

Subsequently, in the same manner, as the third cycle, recharging by the charging device 12, formation of electrostatic latent image of cyan by exposure with the exposing device 13 and development of cyan toner by the third developer unit 14*c* are carried out. Moreover, as the fourth cycle, recharging by the charging device 12, formation of electrostatic latent image of black by exposure with the exposing device 13 and development of black toner by the fourth developer unit 14*d* are performed.

When the development process is completed by the fourth developer unit 14*d*, the toner images of yellow, magenta, cyan and black depending on each electrostatic latent image by the exposure exist on the photosensitive material drum 11.

A toner image formed on the photosensitive material drum 11 as explained above is then charged by the precharging device 15 as required and is then transferred at a time onto the recording sheet 20 by charging with the transfer charging device 16.

Thereafter, the recording sheet 20 is separated from the surface of the photosensitive material drum 11 with charging by the separation charging device 17. This recording sheet 20 is transferred to a fixing device not illustrated and thereby the toner image is fixed on the recording sheet 20, completing the image recording operation.

Upon completion of transfer of toner image and separation process of the recording sheet 20, the toner remaining on the surface of photosensitive material drum 11 is cleaned by a cleaner 18, the remaining charge is discharged by the exposure with the discharge exposing device 19 as the preparation for the next image recording process.

Here, the cleaner 18 is entirely or partially constituted retractable and is not in contact with the photosensitive material drum 11 during formation of the toner image not to disturb the toner on the photosensitive material drum 11.

Cleaning and optical discharge of the photosensitive material drum 11 are performed in the cycle after the transfer of image, and after the transfer of just preceding image, the cleaner 18 is placed in contact with the photosensitive material drum 11 to light the discharge exposing device 19. Thereafter, the cleaner 18 retracts to become non-contact with the photosensitive material drum 11 before the toner image formed by the image forming process reaches the cleaner 18. Moreover, the discharge exposing device 19 goes out.

◎ Example 1 of Experiment:

The inventors of the present invention have conducted an experiment of actual recording of a color image utilizing a color image recording apparatus shown in FIG. 2. In the example 1 of the experiment, an image of two colors of yellow and magenta has been formed using a first developer unit 14*a* and a second developer unit 14*b*.

The image forming process in the example 1 of the experiment will be explained with reference to FIG. 4.

Figure 4A:
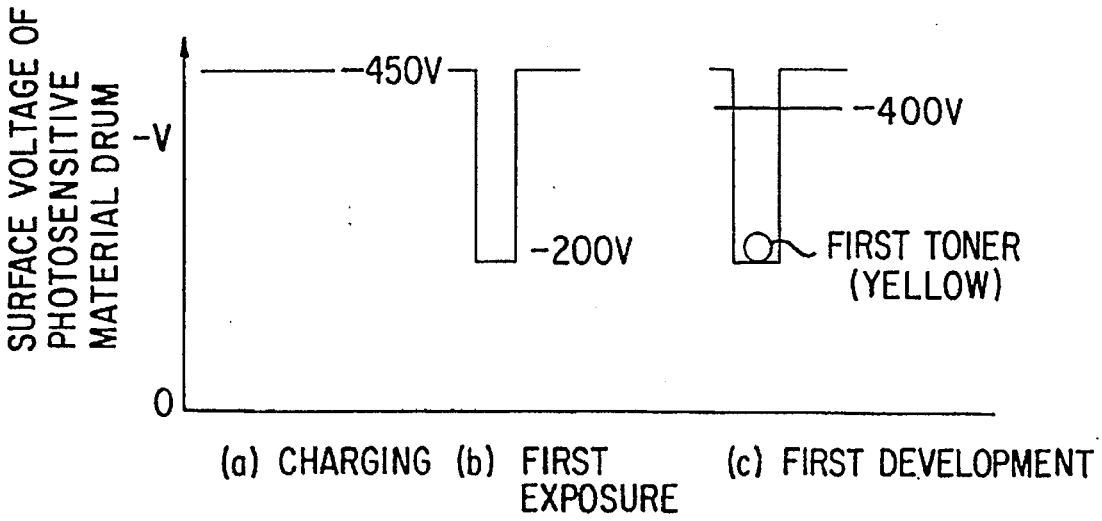
FIGS. 4(*a*) to 4(*f*) are diagrams for explaining voltages in the image forming processes in an example 1 of experiment.
Figure 4B:
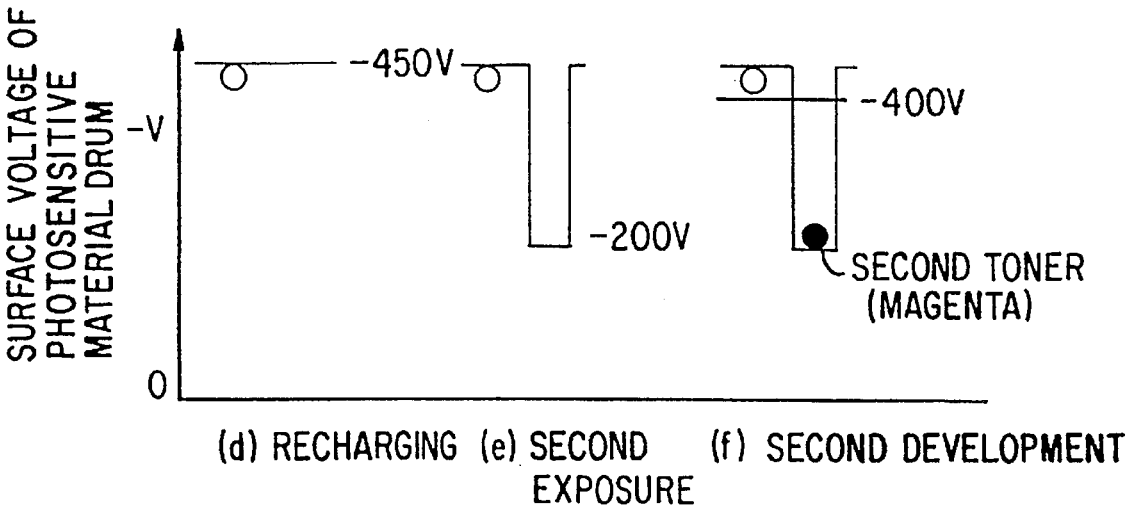

The surface of the OPC photosensitive material drum 11 is uniformly charged to −450 V by the charging device 12 (FIG. 4(*a*)).

Next, an electrostatic latent image having the potential of −200 V at the exposed area is formed by the exposing device 13 through the exposure with the laser beam corresponding to the yellow image (FIG. 4(*b*)).

This electrostatic latent image is developed with the yellow toner by the first developer unit 14*a* (FIG. 4(*c*)).

Subsequently, the first toner image is then charged by the charging device 12. The charged potential is set to −450 V both in the first image section and non-image section (FIG. 4(*d*)).

Thereafter, an electrostatic latent image having the voltage of −200 V at the exposed area is formed by the exposing device 13 through the exposure with the laser beam corresponding to the magenta image (FIG. 4(*e*)) and this latent image is then developed with the magenta toner by the second developer unit 14*b* (FIG. 4(*f*)).

The photosensitive material drum 11 is then uniformly charged negatively with the precharging device 15 so that the carrier adhered on the photosensitive material drum 11 before the transfer of image may be transferred to the recording sheet 20 together with the toner. Thereafter, the yellow and magenta toner images on the photosensitive material drum 11 are transferred at a time to the recording sheet 20 and this toner image is then fixed on the recording sheet 20 with the fixing device not illustrated.

The developer used in the example 1 of experiment will be explained hereunder.

As the toner, a polyester-based toner is used. This toner can be charged negatively and has the weight average grain size of 7 μm for both yellow and magenta colors.

As a carrier, so-called a magnetic powder dispersion type resin carrier where the magnetic powder is dispersed into a resin is used. This carrier can be formed by fusing and kneading styrene-acryl copolymer, magnetite and nigrosine and thereafter smashing into fine particle pieces and can be charged positively.

For the carrier used in the non-contact type development method like this embodiment, small magnetization force per unit volume and low density are preferable. Small magnetization force per unit volume reduces a magnetic repulsive force between chains of the magnetic brush, enabling formation of high density and thinner developer layer on the development roll to reproduce an image having good uniformity.

When the chain of magnetic brush is short, the carrier has a low density and thereby a centrifugal force working on the carrier becomes weak and vibration of carrier is suppressed to prevent carrier adhesion and scattering of carrier.

It is preferable that the carrier has the density of 4.0 g/cm$^2$ or less and a magnetization force per volume in the magnetic field of 1 kOe is 40 emu/cm$^3$ or more but 150 emu/cm$^3$ or less.

The carrier used in this example of experiment has average grain size of 40 m and density of 2.5 g/cm$^2$, magnetization force per unit weight in the magnetic field of 1 kOe of 40 emu/g and magnetization force per unit volume of 100 emu/cm$^3$.

The mixing ratio of toner and carrier is adjusted so that the weight ratio of toner becomes 15 weight % in the yellow developer and becomes 12 weight % in the magenta developer. Meanwhile, amount of charge of toner is adjusted to the range of −12 to −15 C/g.

For both first and second developer units 14*a*, 14*b*, the surface moving line velocity of the cylindrical sleeve 24 is set to 240 mm/s.

Next, the developing bias used in this example of experiment will then be explained.

The developing bias to be applied to the cylindrical sleeve 24 of both first and second developer units 14*a*, 14*b* is so-called a vibration voltage consisting of an AC voltage to which a DC voltage is superimposed.

Figure 5A:
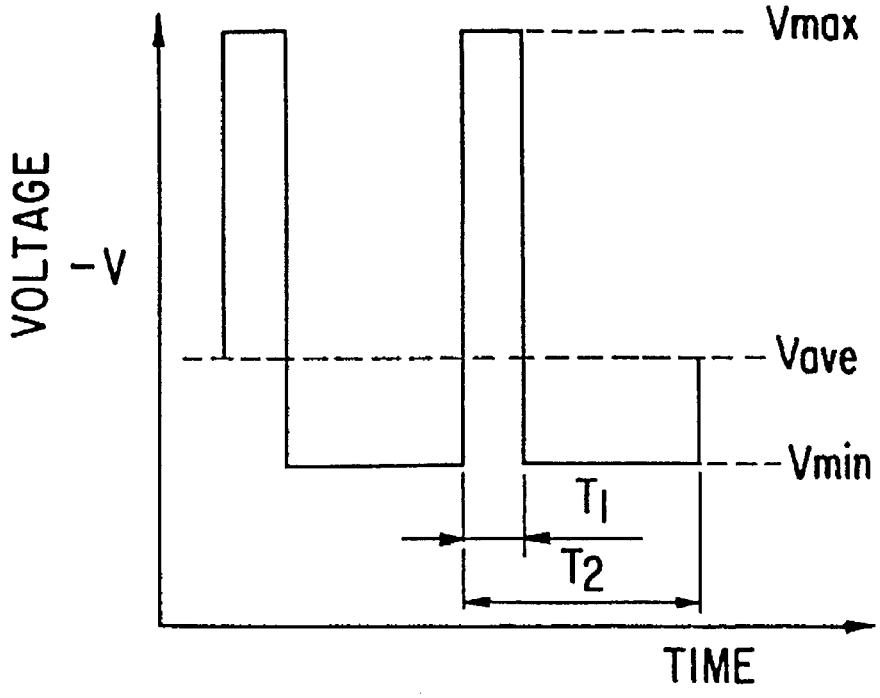
FIG. 5(*a*) is an explanatory diagram indicating a developing bias waveform used in the second developer unit in above example 1 of experiment and FIG. 5(*b*) is an explanatory diagram indicating a symmetrical developing bias waveform used in the first developer unit in above example 1 of experiment.
Figure 5B:
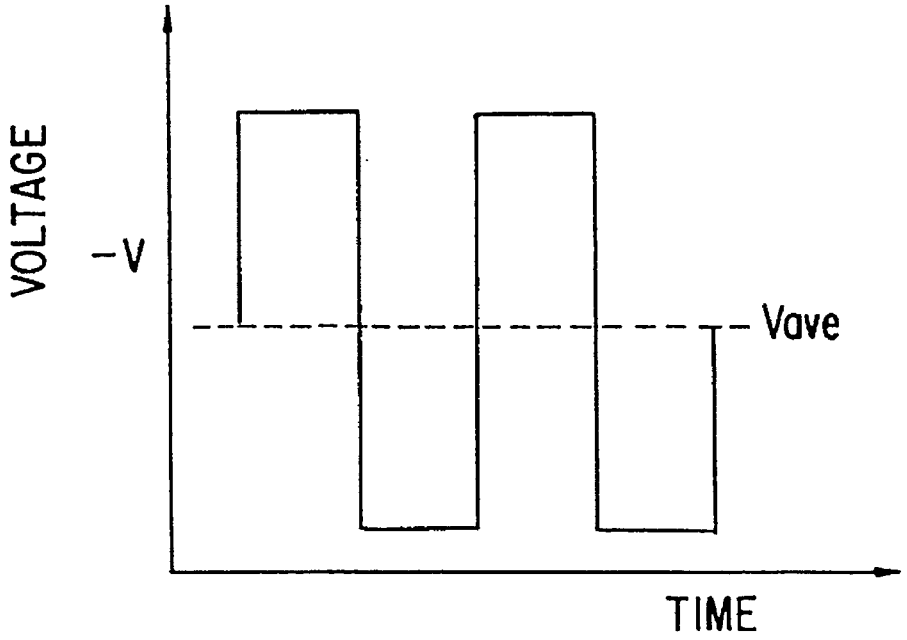

In the case of the first developer unit 14*a*, a rectangular wave of 6 kHz is used as the AC element and an AC voltage $V_{p-p}$ is set to 1.8 kV. The waveform of the AC element is symmetrical as shown in FIG. 5(*b*). Moreover, an average value $V_{ave}$ of the developing bias voltage is set to −400 V.

In this example of experiment, the waveform of the developing bias used for the second developer unit 14*b* is changed to search the relationship with the development characteristic. The waveform of developing bias is shown in FIG. 5(*a*).

In this figure, a rectangular wave is used as the AC element. Moreover, $V_{max}$ and $V_{min}$ indicate respectively the voltages providing the maximum and minimum electric fields to develop the toner image on the photosensitive material drum 11. $V_{ave}$ indicates an average value of the developing bias voltage. A duty ratio means a ratio of the time T1 where the level of the developing bias voltage becomes $V_{max}$ in one period T2 of the AC element,1 that is, T1/T2. Moreover, the AC voltage $V_{p-p}$ indicates $|V_{max}-V_{min}|$.

Meanwhile, the AC voltage $V_{p-p}$ is set to 1.8 kV. This value is selected not to allow the first development toner image on the photosensitive material drum 11 to inversely scatter onto the cylindrical sleeve 24 of the second developer unit 14*b* when the symmetrical (duty ratio is 0.5) wave is used.

Generation of inverse scattering of toner image has been confirmed, in the image forming process shown in FIG. 4, depending on generation of deposition of yellow toner onto the cylindrical sleeve 24 when the developing bias explained above is applied in the second development process of FIG. 4(*f*) under the condition that the developer layer does not exist on the cylindrical sleeve 24 of the second developer unit 14*b*.

Next, in the Table 1, relationship between the duty ratio and $V_{max}$, $V_{min}$ is indicated under the condition that $V_{p-p}$= 1.8 (kV) and $V_{ave}$=−400 (V).

TABLE 1

| Duty ratio | Vmax (V) | Vmin (V) |
|---|---|---|
| 0.15 | −1930 | −130 |
| 0.25 | −1750 | 50 |
| 0.35 | −1570 | 230 |
| 0.45 | −1390 | 410 |
| 0.50 | −1300 | 500 |

Figure 6:
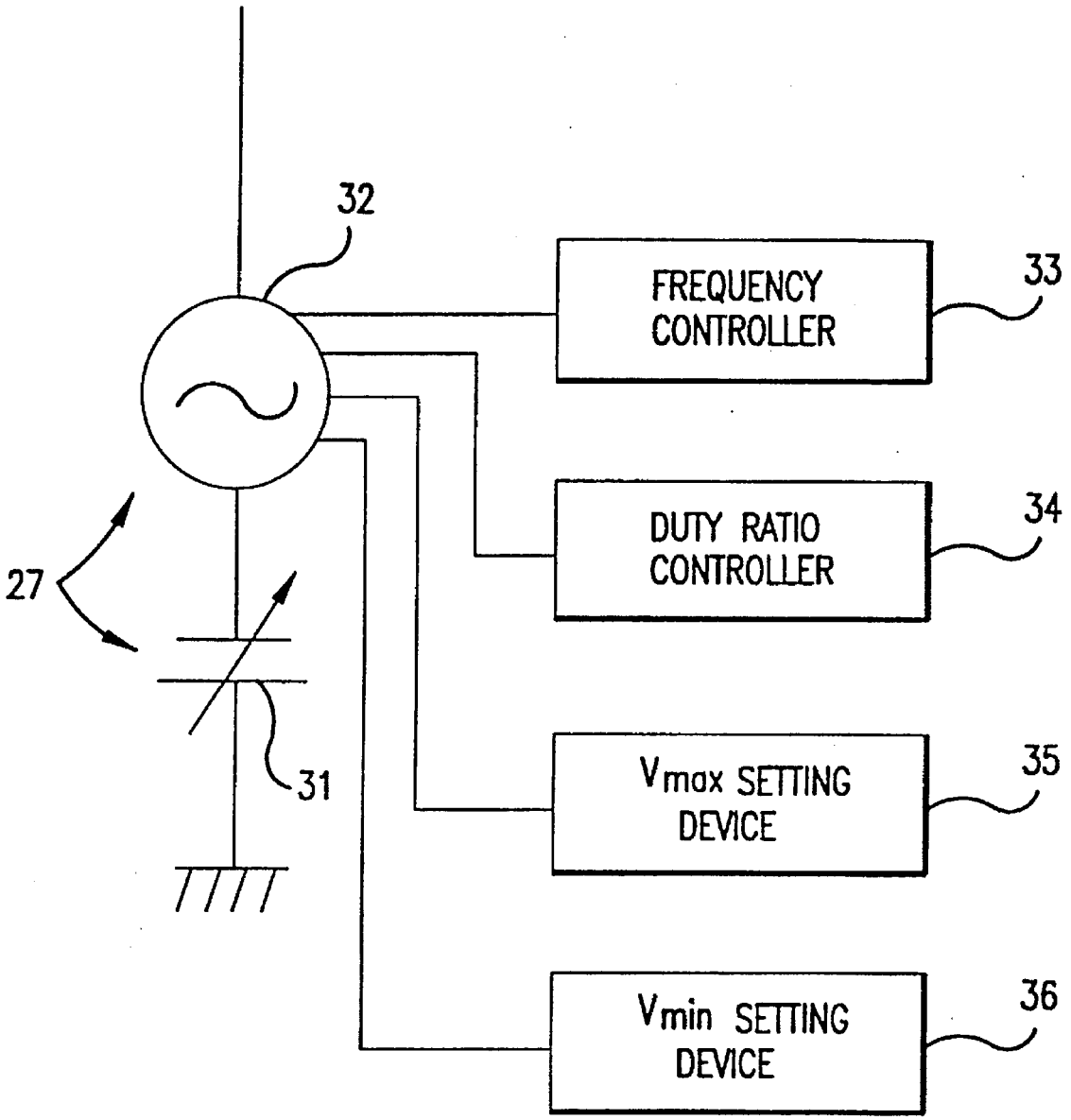
FIG. 6 is an explanatory diagram indicating an example of the developing bias power supply to form a developing bias waveform used in the second developer unit in above example 1 of experiment.

Moreover, as the bias power supply 27 of this example of experiment, the power supply as shown in FIG. 6, for example, is used to change the waveform of the developing bias used in the second developer unit 14*b*.

In this figure, the bias power supply 27 comprises a DC bias power supply 31 for applying the DC voltage element and an AC bias power supply 32 for applying the AC voltage element.

The DC bias power supply 31 variably controls the DC voltage element, while the AC bias power supply 32 comprises a frequency controller 33 for variably controlling the frequency of the AC voltage element, a duty ratio controller 34 for variably controlling the duty ratio, a $V_{max}$ setting device 35 for setting $V_{max}$ of the AC voltage element and a $V_{min}$ setting device 36 for setting $V_{min}$ of the AC voltage element to variably set the AC voltage element by adequately adjusting these devices.

Here, relationship of mixing of second toner color into the first toner image, density of second toner image, carrier deposition in the second development process with change of frequency of the AC element and duty ratio has been searched. Moreover, the same search has also been performed using the symmetrical (duty ratio is 0.5) wave for the comparison purpose.

For evaluation of result, limit samples are used to visually evaluate the mixing of second toner color into the first toner image.

Here, the level where mixing of color cannot be confirmed visually is defined as Grade (hereinafter expressed as G) 1, the level where a little mixing of color can be recognized but there is no problem on the practical use is defined as G2, and the level indicating the mixing of color is as high as disabling practical use is defined as G3. G1 and G2 are recognized to pass the evaluation and given the mark ○ but G3 is not recognized to pass the evaluation and given the mark.

Moreover, for the measurement of density of the second image, a full-size solid image on the recording sheet has been measured with a reflection type densitometer (Brand Name: X-RITE310). Since the sufficient image density should be 1.8 or higher, the density of 1.8 or higher is recognized to pass the evaluation and is given the mark ○ but the density under 1.8 is not recognized to pass the evaluation and is given the mark.

In addition, carrier deposition has been evaluated at the so-called alternate line section where the line images and backgrounds are arranged with a constant period. The period of alternate line is 2 cycles/mm and a ratio of the image section and background section is 1:1.

For the evaluation, an area coefficient of carrier particles on the background section has been measured using an image analyzing apparatus (Brand Name: LUZEX-5000).

Here, the surface contact coefficient of carrier particles of 1.0% or less does not bring about any problem on the practical use. Therefore, the level of 1.0 or less is recognized to pass the evaluation and is given the mark ○ but the level exceeding 1.0% is not recognized to pass and given the mark.

As a result of evaluation, the data of Table 2 can be obtained. As the overall evaluation, the mark ○ is given when above three items are all recognized to pass and given the mark ○, but the mark is given when any one of above items is not recognized to pass and given the mark.

TABLE 2

| Frequency (kHz) | Duty ratio | Mixing of colors | | Density of second image | | Surface contact coefficient of carrier | | Overall evaluation |
|---|---|---|---|---|---|---|---|---|
| 2 | 0.15 | G3 | x | 1.81 | o | 0.74 | o | x |
| | 0.25 | G3 | x | 1.91 | o | 0.87 | o | x |
| | 0.35 | G3 | x | 1.97 | o | 1.20 | x | x |
| | 0.43 | G3 | x | 1.92 | o | 1.56 | x | x |
| | 0.50 | G3 | x | 1.89 | o | 1.88 | x | x |
| 4 | 0.15 | G3 | x | 1.80 | o | 0.27 | o | x |
| | 0.25 | G2 | o | 1.86 | o | 0.37 | o | o |
| | 0.35 | G2 | o | 1.93 | o | 0.44 | o | o |
| | 0.45 | G2 | o | 1.85 | o | 0.89 | o | o |
| | 0.50 | G2 | o | 1.81 | o | 1.16 | x | x |
| 6 | 0.15 | G3 | x | 1.74 | x | 0.12 | o | x |
| | 0.25 | G2 | o | 1.86 | o | 0.15 | o | o |
| | 0.35 | G1 | o | 1.90 | o | 0.16 | o | o |
| | 0.45 | G1 | o | 1.83 | o | 0.21 | o | o |
| | 0.50 | G1 | o | 1.78 | x | 0.28 | o | x |
| 10 | 0.15 | G2 | o | 1.62 | x | 0.04 | o | x |
| | 0.25 | G1 | o | 1.82 | o | 0.04 | o | o |
| | 0.35 | G1 | o | 1.86 | o | 0.04 | o | o |
| | 0.45 | G1 | o | 1.81 | o | 0.06 | o | o |
| | 0.50 | G1 | o | 1.75 | x | 0.07 | o | x |
| 12 | 0.15 | G1 | o | 1.38 | x | 0.02 | o | x |
| | 0.25 | G1 | o | 1.56 | x | 0.02 | o | x |
| | 0.35 | G1 | o | 1.65 | x | 0.03 | o | x |
| | 0.45 | G1 | o | 1.58 | x | 0.05 | o | x |
| | 0.50 | G1 | o | 1.52 | x | 0.05 | o | x |

From the Table 2, it can be understood that image density changes depending on duty ratio and image density becomes maximum when the duty ratio is 0.35 under the condition that the frequency is equal.

Such operations will then be explained hereunder.

From the Table 1, it can also be understood that the smaller the duty ratio is, the higher an absolute value of $V_{max}$ becomes and the larger an absolute value of voltage difference between the voltage of image section and $V_{max}$ becomes. Therefore, the smaller the duty ratio is, the larger the maximum value of the electric field working in the direction as developing the toner onto the photosensitive material drum 1 becomes. Thereby, in this case, the toner having a higher adhesive force with the carrier or the toner having small amount of charge and smaller coulomb force applied from the developing electric field can be separated from the carrier for the scattering purpose.

Meanwhile, the smaller the duty ratio is, the shorter the period T1 where the developing bias voltage $V_{max}$ to give the electric field working in such a direction as developing the toner onto the photosensitive material drum 11 becomes. Accordingly, when the duty ratio becomes small, the distance in which the toner scatters within the period T1 becomes short. Thereby the direction of electric field is inverted before the toner reaches the photosensitive material drum 11 and the toner is no longer easily developed on the photosensitive material drum 11.

With the above-mentioned two kinds of operation depending on the duty ratio, the image density becomes maximum when the duty ratio is 0.35. When the frequency is set to 10 kHz or lower and the duty ratio is set in the range from 0.25 to 0.45, sufficient developing electric field may be applied on the toner and sufficient time is reserved to develop the toner on the photosensitive material drum 11, the target image density can be realized.

From the Table 2, on the other hand, it can also be understood that the lower the duty ratio is, the smaller the carrier deposition becomes.

From the Table 1, it can be obvious that the lower the duty ratio, the smaller an absolute value of voltage difference between the voltage of background section and $V_{min}$ becomes. Therefore, the lower the duty ratio is, the smaller the electric field working in such a direction as developing the carrier charged in the inverse polarity of the toner onto the photosensitive material drum 11 becomes. Accordingly, amplitude of vibration of carrier due to the electric field becomes small, controlling the contact of the carrier with the photosensitive material drum 11.

In addition, when the frequency is set to 4 kHz or higher, vibration of carrier which has a larger mass than toner cannot follow the change of the electric field, preventing generation of carrier deposition. Simultaneously, since the carrier is prevented to be in contact with the surface of photosensitive material drum 11, disturbance and removal of the first toner can also be prevented.

Further, from the Table 2, it can be understood in regard to the mixing of colors that the lower the duty ratio is or the lower the frequency is, the worse the grade becomes.

This is because, in the former case, the lower the duty ratio is, the larger an absolute value of a voltage difference between the voltage of first image section and $V_{max}$ becomes and the larger the electric field working in the direction as developing the toner to the first image section becomes, and because, in the latter case, the lower the frequency is, the longer the time T1 where $V_{max}$ of the developing bias voltage is applied becomes and thereby the toner reaches the first image section more easily.

As explained above, when the frequency is set to 4 kHz or higher and the duty ratio is set in the range from 0.25 to 0.45, the toner is controlled to reach the first image section, preventing mixing of colors.

In summary, when the duty ratio is set in the range from 0.25 to 0.45 and the frequency is set in the range from 4 kHz to 10 kHz, mixing of color to the first image and carrier deposition can be prevented and sufficient image density can also be obtained.

Also proposed is a method of enhancing the image density by increasing an amount of developer to be supplied by improving the surface moving line velocity of the cylindrical sleeve 24 without changing waveform of the developing bias voltage, in this case, however, sufficient image density can be obtained in the case of the recording of a full-size solid image, resulting in a problem of the reproducibility of line image. Particularly, in this method, it is difficult to improve reproducibility of ultra-fine lines exposed by one dot. Moreover, in this method, a centrifugal force working on the carrier increases with increase of the surface moving line velocity of the cylindrical sleeve 24, resulting in a problem that scattering of carrier is generated more easily.

On the other hand, according to the method of this embodiment, sufficient image density can be obtained for both full-size solid image and line image without increasing the surface moving line velocity of the cylindrical sleeve 24 by setting the waveform of the developing bias voltage as explained above and scattering of carrier can also be prevented.

Example 2 of Experiment:

The inventors of the present invention have conducted an experiment by changing the toner particles utilizing the color recording apparatus shown in FIG. 2.

In this example 2 of the experiment, two kinds of images of yellow and magenta are formed utilizing the first and second developer units 14*a*, 14*b* as in the case of the example 1. The image forming process is identical to that in the example 1.

In the first developer unit 14*a*, the toner and carrier which are identical to that used in the example 1 are used and a mixing ratio of toner and carrier is adjusted to 12 weight %. In this case, the amount of charge of the toner is set to −15 C/g.

In the second developer unit 14*b*, amount of charge of toner has been changed by changing a kind of toner. As the amount of charge of toner, three kinds of amounts, −3 C/g, −15 C/g, −25 C/g have been used. Moreover, the carrier used is the same as that used in the example 1 and a mixing ratio of the toner and carrier is adjusted to 12 weight %.

Next, the developing bias used in this example 2 will then be explained.

For both first and second developer unit 14*a* and 14*b*, a rectangular wave of 6 kHz is used as the AC element, a duty ratio is set to 0.35 and an AC voltage $V_{p-p}$ is set to 1.8 kV. Moreover, the average value $V_{ave}$ of the developing bias voltage is set to −400 V for both first and second developer units 14*a*, 14*b*. Moreover, a symmetrical (duty ratio is 0.5) wave is also used for the comparison purpose.

Evaluation items and evaluation method are same as those in the example 1. As a result, the Table 3 has been obtained.

TABLE 3

| Toner speed | Duty ratio | Mixing of colors | | Density of second image | | Surface contact coefficient of carrier | | Overall evaluation |
|---|---|---|---|---|---|---|---|---|
| | 0.35 | G1 | o | 1.87 | o | 0.06 | o | o |
| | 0.50 | G1 | o | 1.61 | x | 0.08 | o | x |
| | 0.35 | G1 | o | 1.90 | o | 0.16 | o | o |
| | 0.50 | G1 | o | 1.78 | x | 0.28 | o | x |
| | 0.35 | G1 | o | 1.85 | o | 0.38 | o | o |
| | 0.50 | G1 | o | 1.42 | x | 2.23 | x | x |

From the Table 3, it is obvious that when the duty ratio is set to 0.35, sufficient image density can be obtained without generation of mixing of colors and carrier scattering both in the cases when the amount of charge of toner is low and high.

As is already described regarding the example 1 of experiment, when the duty ratio is set to 0.35, the maximum value of the electric field working in the direction to develop the toner to the photosensitive material drum 11 is larger than that when it is set to 0.5. Therefore, the toner which has small amount of charge and receives a smaller coulomb force from the developing electric field and the toner which has large amount of charge and has a larger adhesive force with the carrier can be separated and scattered from the carrier. Therefore, sufficient image density can be obtained not depending on the amount of charge of toner.

In addition, the electric field working in the direction to develop the carrier on the surface of the photosensitive material drum 11 becomes smaller, when the duty ratio is 0.35, than that when it is 0.5. Therefore, even in the case of the toner, having larger amount of charge and also larger amount of charge of carrier, amplitude of vibration of carrier due to the electric field is kept small, controlling contact of carrier with the surface of photosensitive material drum 11. Accordingly, disturbance and removal of the first toner are not generated.

In this example 2 of experiment, the duty ratio of AC element of the developing bias voltage is set to 0.35 and frequency is set to 6 kHz, but when the duty ratio is set in the range from 0.25 to 0.45 and the frequency is set in the range from 4 KHz to 10 kHz, if amount of charge of toner has changed due to the environmental influence or passage of time, sufficient image density can be obtained without generation of mixing of color into the first image and carrier deposition.

Example 3 of Experiment:

In this example 3 of experiment, a full-color image has been formed utilizing the first developer unit 14*a* to the fourth developer unit 14*d*.

In this example, as the first developer unit 14*a* and second developer unit 14*b*, those similar to that used in the example 1 of experiment are used, moreover as the developing bias conditions of the third developer unit 14*c* and fourth developer unit 14*d*, those similar to that of the second developer unit 14*b* are used. Thereby, the following results have been obtained by examining the quality of mixing of colors of the second toner, third toner and fourth toner into the first image, image density of the second to fourth images, and carrier deposition while the developing bias condition is changed. Namely, when the duty ratio is set in the range from 0.25 to 0.46 and the frequency is set to the range from 4 kHz to 10 kHz as the developing bias conditions of the second developer unit 14*b* to the fourth developer unit 14*d*, even when the amount of charge of toner has changed due to environmental influence or passage of time, a full-color image of sufficient image density can be confirmed without generation of mixing of color to the first image and carrier deposition.

◎ Modification Examples:

In above embodiment, a rectangular wave is used as the waveform of the AC element of the developing bias voltage, but similar effect can also be obtained even when a sine wave is used or the desired waveform in which the voltage changes is in the shape of triangle or in some other shape.

Moreover, in above embodiment, a plurality of magnetic poles having different polarities 251 to 254 are alternately arranged within the development roll 23 in the effective development region M, but the magnetic poles of the same polarity can also be arranged adjacently. Otherwise, the magnetic poles in different polarities may be arranged in the area other than the effective development region M.

Further, in above embodiment, a magnetic pole is arranged at almost intermediate position of the adjacent magnetic poles in the development roll 23 at the position where the development roll 23 is located nearest the photosensitive material drum 11, but the magnetic pole may also be provided approximately facing the photosensitive material drum 11.

Furthermore, in above embodiment, as the magnetic carrier in the double-element developer, so-called a magnetic powder dispersion type resin carrier where magnetic powder is dispersed into the binding resin is used, but a desired carrier such as the carrier where the spherical ferrite particles are covered with resin may be used.

In addition, in above embodiment, exposing of the image section and inversion development are repeatedly conducted but the image forming process is not limited thereto and a desired image forming process can also be applied.

Moreover, in above embodiment, as the latent image carrier, a photosensitive material is used, but it is also possible to use a dielectric material as the latent image carrier to form an electrostatic latent image with a discharge recording head used in an electrostatic printer or an ion flow type recording head disclosed in the Japanese Patent Laid-Open No. SHO 59-190854.

As described above, according to the present invention, since a double-element non-contact alternate electric field development method is employed as at least second and subsequent development processes of a color image recording system in such a type that after the toner images in a plurality of colors are formed on the latent image carrier, these toner images are transferred at a time to the image acceptor, and as the developing bias conditions, an absolute value of the difference between the maximum bias voltage which provides maximum toner developing electric field working in the direction to the side of the latent image carrier and the average value of the developing bias is set larger than an absolute value of the difference between the minimum bias voltage which provides the minimum toner developing electric field working in the direction to the side of the latent image carrier and the average value of the developing bias and moreover the bias voltage region higher than the average value of the developing bias including the maximum developing bias explained above is set to the ratio of 0.25 to 0.45 for one period of the AC voltage element, sufficient time can be obtained for developing the toner onto the latent image carrier corresponding to the image section and the toner cannot reach the area on the latent image carrier corresponding to the background section.

Thereby, generation of fogging can be prevented effectively and sufficient image density can also be obtained while effectively avoiding disturbance and removal (mixing of colors) of toner image in the preceding stage which is features of the non-contact development method and moreover migration of toner in the preceding stage to the development means of the subsequent stages.

Moreover, since movement of carrier is no longer followed by the electric field by setting the frequency of the AC voltage element to the range of 4 kHz to 10 kHz, if amount of charge of carrier increases due to environmental change or passage of time, electrostatic vibration of the carrier can be kept small.

Therefore, generation of carrier deposition can be controlled while effectively avoiding disturbance and removal of toner image in the preceding stage and migration of toner in the preceding stage into the development means in the subsequent stages and deterioration of image quality due to carrier deposition can be prevented effectively.

Moreover, in the present invention, the development efficiency in the effective development region can be more enhanced by alternately arranging a plurality of magnetic poles in different polarities, for example, in the developer carrier in the effective development region at least in the second and subsequent development processes.

Thereby, an AC voltage element of the developing bias can be set to a lower value and electrical disturbance and removal of the toner image in the preceding stage and generation of carrier deposition can be as much prevented more effectively.

In addition, since the surface moving line velocity of the developer carrier can be set to a lower value, scattering of carrier can be prevented effectively and such feature can also be applied to the high speed process.

What is claimed is:

1. A color image recording method for transferring at a time toner images in a plurality of colors to an image acceptor after forming such toner images in a plurality of colors on a latent image carrier by repeating the latent image forming process and development process for a plurality of times, wherein;

at least the second and subsequent development processes comprise the steps of;

arranging separately a developer carrier providing therein a plurality of magnetic poles of different polarities alternately arranged within the area thereof corresponding to an effective developing region in separation from said latent image carrier, transferring double-element developer consisting of toner and magnetic carrier onto said developer carrier while said developer is supported to be non-contact with said latent image carrier, and applying a developing bias consisting of an AC voltage to which a DC voltage is superimposed to said developer carrier to develop an electrostatic latent image formed on said latent image carrier with the toner, an absolute value of the difference between the maximum bias voltage which provides the maximum toner developing electric field working in the direction to the side of said latent image carrier and an average value of the developing bias is set larger than an absolute value of the difference between the minimum bias voltage which provides the minimum toner developing field working in the direction to the side of said latent image carrier and an average value of the developing bias, and a bias voltage region located between said maximum bias voltage and average value of the developing bias is set to a ratio in the range from 0.25 to 0.45 for one period of the AC voltage element.

2. A color image recording method according to claim 1, wherein the frequency of the AC voltage element of the developing bias is set in the range from 4 kHz to 10 kHz at least in the second and subsequent development processes.

3. The color image recording method according to claim 1, wherein the developing bias is a rectangular pulse.

4. The color image recording method according to claim 3, wherein the peak value of the rectangular pulse changes with time.

5. The color image recording method according to claim 1, wherein the developing bias is a sine wave signal.

6. A color image recording method for transferring at a time toner images in a plurality of colors to an image acceptor after forming such toner images in a plurality of colors on a latent image carrier by repeating the latent image forming process and development process for a plurality of times, wherein;

at least the second and subsequent development processes comprise the steps of:

arranging separately a developer carrier providing therein a plurality of magnetic poles of different polarities alternately arranged within the area thereof corresponding to an effective developing region in separation from said latent image carrier, transferring double-element developer consisting of toner and magnetic carrier onto said developer carrier while said developer is supported to be non-contact with said latent image carrier, and applying a developing bias consisting of an AC voltage to which a DC voltage is superimposed to said developer carrier to develop an electrostatic latent image formed on said latent image carrier with the toner, an absolute value of the difference between the maximum bias voltage which provides the maximum toner developing electric field working in the direction to the side of said latent image carrier and an average value of the developing bias is set larger than an absolute value of the difference between the minimum bias voltage which provides the minimum toner developing field working in the direction to the side of said latent image carrier and an average value of the developing bias, and a ratio C/T of the time C taking a value which is equal to or larger than the average value of said developing bias to the period T of the AC voltage is obtained using a ratio A/B which is determined by the present absolute values A and B, and a value of the ratio C/T is set within the range from 0.25 to 0.45.

7. The color image recording method according to claim 6, wherein the frequency of the AC voltage element of the developing bias is set in the range from 4 kHz to 10 kHz at least in the second and subsequent development processes.

8. The color image recording method according to claim 6, wherein the developing bias is a rectangular pulse.

9. The color image recording method according to claim 8, wherein the peak value of the rectangular pulse changes with time.

10. The color image recording method according to claim 6, wherein the developing bias is a sine wave signal.

* * * * *